US005794927A

United States Patent [19]

Uchida

[11] Patent Number: 5,794,927

[45] Date of Patent: Aug. 18, 1998

[54] SHEET CONVEYING APPARATUS

[75] Inventor: Haruo Uchida, Yokohama, Japan

[73] Assignee: Canon Kabushiki Kaisha, Tokyo, Japan

[21] Appl. No.: 552,959

[22] Filed: Nov. 3, 1995

[30] Foreign Application Priority Data

Nov. 7, 1994 [JP] Japan ..... 6-272316

[51] Int. Cl.[6] ..... B65H 5/22

[52] U.S. Cl. ..... 271/3.18; 271/3.2; 271/3.21; 271/270; 271/272; 271/314

[58] Field of Search ..... 271/3.18, 3.2, 271/3.21, 270, 272, 273, 274, 275, 314; 346/134, 139 A; 347/104, 153, 215, 218, 262, 264

[56] References Cited

U.S. PATENT DOCUMENTS

| | | | |
|---|---|---|---|
| 4,831,461 | 5/1989 | Ohta et al. | 271/270 X |
| 4,991,828 | 2/1991 | Mizoguchi | 271/3.2 |
| 5,531,436 | 7/1996 | Ohyama et al. | 271/275 |

*Primary Examiner*—David H. Bollinger

*Attorney, Agent, or Firm*—Fitzpatrick, Cella, Harper & Scinto

[57] ABSTRACT

The present invention provides a sheet conveying apparatus in which a belt is wound around an outer peripheral surface of a convey rotary member for conveying a sheet and an outer peripheral surface of a drive pulley for transmitting a rotational force to the convey rotary member or an outer peripheral surface of a drive shaft of the drive pulley, so that a rotational force of the drive pulley is transmitted to the convey rotary member by way of the belt.

74 Claims, 5 Drawing Sheets

SHEET CONVEYING APPARATUS

BACKGROUND OF THE INVENTION

1. Field of the Invention

The present invention relates to a sheet conveying apparatus for conveying a sheet in a recording apparatus.

2. Related Background Art

An example of a conventional sheet conveying apparatus used with a recording portion of a conventional ink jet recording apparatus will be explained with reference to FIG. 5. In FIG. 5, at an upstream side of a recording head 1 in a sheet conveying direction, there is disposed a first convey roller 2 for conveying a sheet 4 to a recording area where the recording head 1 is opposed to the sheet, and, at a downstream side of the recording head 1, there is disposed a second convey roller 3 for discharging the sheet 4 out of the ink jet recording apparatus. Pinch rollers 11, 12 are urged against the first and second convey rollers 2, 3, respectively, with predetermined biasing forces.

A platen plate 10 is disposed in the recording area of the recording head 1, and, when the sheet reaches the recording area, the sheet 4 is supported on the platen plate 10. Drive pulleys 50, 51 each having a diameter greater than those of the convey rollers 2, 3 are secured to roller shafts of the convey rollers 2, 3, respectively, by press fit and the like. The drive pulleys, 50, 51 are connected to a motor pulley 17 of a drive motor 16 via timing belts 52, 53, respectively, so that a rotational force of the drive motor 16 is transmitted to the convey rollers 2, 3.

The diameters of the drive pulleys 50, 51 or a diameter of the motor pulley 17 are selected so that a convey speed of the convey roller 3 becomes slightly greater than a convey speed of the convey roller 2. With this arrangement, after a tip end of the sheet 4 leaves the convey roller 2, when the tip end of the sheet enters into a nip between the convey roller 3 and the pinch roller 12, even if the sheet is flexed, such flexion of the sheet can be eliminated due to the difference in convey speed, thereby preventing the sheet 4 from floating toward the recording head 1.

However, in the above-mentioned conventional technique, in order to accurately convey the sheet 4 through the recording area including the recording head 1, it is necessary to increase (i) accuracy of the outer diameters and run-out tolerance of the convey rollers 2, 3, (ii) accuracy of run-out tolerances of the drive pulleys 50, 51 and (iii) accuracy of run-out tolerances of the drive pulleys 50, 51 with respect to the outer diameters of the convey rollers 2, 3 after the drive pulleys 50, 51 are secured to the convey rollers 2, 3 by press fit or the like.

If it is tried to increase the above-mentioned accuracies, the manufacturing cost of the convey rollers 2, 3 and the drive pulleys 50, 51 will be greatly increased. Further, when greater accuracy is required, even if the tolerance of the parts is improved, such greater accuracy cannot be achieved. Thus, it is necessary that the conveyed amount of the sheet is detected by using an encoder and the like and a means must be provided for controlling the rotational amount of the drive motor 16. Consequently, the number of parts is increased and the apparatus itself becomes bulky, resulting in the increase in cost of the apparatus.

Furthermore, since the convey speed of the convey roller 3 is slightly greater than the convey speed of the convey roller 2, after a trail end of the sheet 4 leaves the convey roller 2, when the sheet is conveyed by the convey roller 3 alone, the conveyed amount of the sheet 4 becomes greater than the normal conveyed amount (of the sheet), with the result that characters or an image recorded on the sheet is distorted.

In addition, since the drive pulleys 50, 51 having the diameters greater than the diameters of the convey rollers 2, 3 are secured to the convey rollers 2, 3, the heights of the uppermost portions of the drive pulleys 50, 51 become higher than the lower end of the recording head 1 (i.e. the drive pulleys are overlapped with the recording head in the vertical direction), with the result that the drive pulleys 50, 51 must be positioned out of the recording area where the recording head 1 is reciprocally shifted with respect to the platen plate 10. Thus, the dimension of the apparatus is increased.

SUMMARY OF THE INVENTION

The present invention aims to eliminate the above-mentioned conventional drawbacks, and an object of the present invention is to provide a sheet conveying apparatus which can be made compact with simple construction and in which a sheet can be conveyed with high accuracy.

To achieve the above object, according to the present invention, there is provided a sheet conveying apparatus wherein a flat belt is wound around an outer peripheral surface of a convey rotary member for conveying a sheet and an outer peripheral surface of a drive pulley for transmitting a rotational force to the convey rotary member and wherein a rotational force of the drive pulley is transmitted to the convey rotary member by means of the flat belt.

According to another aspect of the present invention, there is provided a sheet conveying apparatus wherein a flat belt is wound around an outer peripheral surface of a first convey rotary member disposed at an upstream side of a recording head in a sheet conveying direction and adapted to convey a sheet, an outer peripheral surface of a second convey rotary member disposed at a downstream side of the recording head in the sheet conveying direction and adapted to convey the sheet, and an outer peripheral surface of a drive pulley for transmitting a rotational force to the first and second convey rotary members or an outer peripheral surface of a pulley shaft of the drive pulley and wherein a rotational force of the drive pulley is transmitted to the first and second convey rotary members by means of the flat belt.

After a tip end of the sheet leaves the first convey rotary member and before the tip end of the sheet enters into the second convey rotary member, a conveyed amount of the sheet conveyed by the second convey rotary member may be greater than a conveyed amount of the sheet conveyed by the first convey rotary member, and, after the tip end of the sheet leaves the second convey rotary member, the conveyed amount of the sheet conveyed by the first convey rotary member may be the same as the conveyed amount of the sheet conveyed by the second convey rotary member.

Incidentally, it is preferable that a conveying force of the second convey rotary member is smaller than a conveying force of the first convey rotary member.

In the sheet conveying apparatus according to the present invention, since the flat belt is wound around the outer peripheral surface of the convey rotary member and the outer peripheral surface of the drive pulley or the outer peripheral surface of the pulley shaft of the drive pulley, a shift amount of the outer peripheral surface of the drive pulley or the outer peripheral surface of the pulley shaft of the drive pulley can be directly converted into a shift amount of the outer peripheral surface of the convey rotary member via the flat belt and these two shift amounts can be the same as each other. Accordingly, the shift amount of the outer peripheral surface of the drive pulley or the outer peripheral surface of the pulley shaft of the drive pulley becomes the conveyed amount of the sheet conveyed by the convey rotary member. Thus, by controlling the shift amount of the outer peripheral surface of the drive pulley or the outer peripheral surface of the pulley shaft of the drive pulley, the conveyed amount of the sheet can be controlled correctly.

Further, since the flat belt is wound around the outer peripheral surface of the first convey rotary member disposed at the upstream side of the recording head in the sheet conveying direction, the outer peripheral surface of the second convey rotary member disposed at the downstream side of the recording head in the sheet conveying direction, and the outer peripheral surface of the drive pulley or the outer peripheral surface of the pulley shaft of the drive pulley, a shift amount of the outer peripheral surface of the drive pulley or the outer peripheral surface of the pulley shaft of the drive pulley can be directly converted into shift amounts of the outer peripheral surfaces of the first and second convey rotary members via the flat belt and these three shift amounts can be the same as each other. Accordingly, the shift amount of the outer peripheral surface of the drive pulley or the outer peripheral surface of the pulley shaft of the drive pulley becomes the conveyed amount of the sheet conveyed by the first and second convey rotary members. Thus, by controlling the shift amount of the outer peripheral surface of the drive pulley or the outer peripheral surface of the pulley shaft of the drive pulley, the conveyed amount of the sheet can be controlled correctly. Further, since the shift amounts of the outer peripheral surfaces of the first and second convey rotary members can be same as each other, a conveying speed of the sheet can always be stabilized.

In addition, since the conveyed amount of the sheet is determined by the shift amounts of the outer peripheral surfaces of the rotary convey members, the shift amount of the outer peripheral surface of the drive pulley or the outer peripheral surface of the pulley shaft of the drive pulley is transmitted to the convey rotary members with high accuracy regardless of the tolerance of the outer diameters of the convey rotary members, with the result that the sheet can be conveyed with high accuracy.

Further, since the drive pulley is not secured to the convey rotary members, the recording head is not overlapped with the drive pulley in a vertical direction, thereby making the apparatus compact.

Furthermore, since the conveying amount of the second convey rotary member is greater than the conveying amount of the first convey rotary member after the tip end of the sheet leaves the first convey rotary member and before the tip end of the sheet enters into the second convey rotary member, after the tip end of the sheet leaves the first convey rotary member, when the tip end of the sheet enters into the second convey rotary member, even if the sheet has a loop, such a loop can be eliminated.

Further, since the conveying amount of the first convey rotary member becomes the same as the conveying amount of the second convey rotary member after the tip end of the sheet leaves the second convey rotary member, after the tip end of the sheet leaves the first convey rotary member, when the sheet is conveyed by the second convey rotary member alone, the sheet can be conveyed at the normal conveying speed.

Incidentally, when the conveying force of the second convey rotary member is smaller than the conveying force of the first convey rotary member, after the loop in the sheet is eliminated, a tension force (not affecting an influence to the conveyance of the first convey rotary member) can be applied to the sheet by the second convey rotary member.

DETAILED DESCRIPTION OF THE PREFERRED EMBODIMENTS

Figure 1:
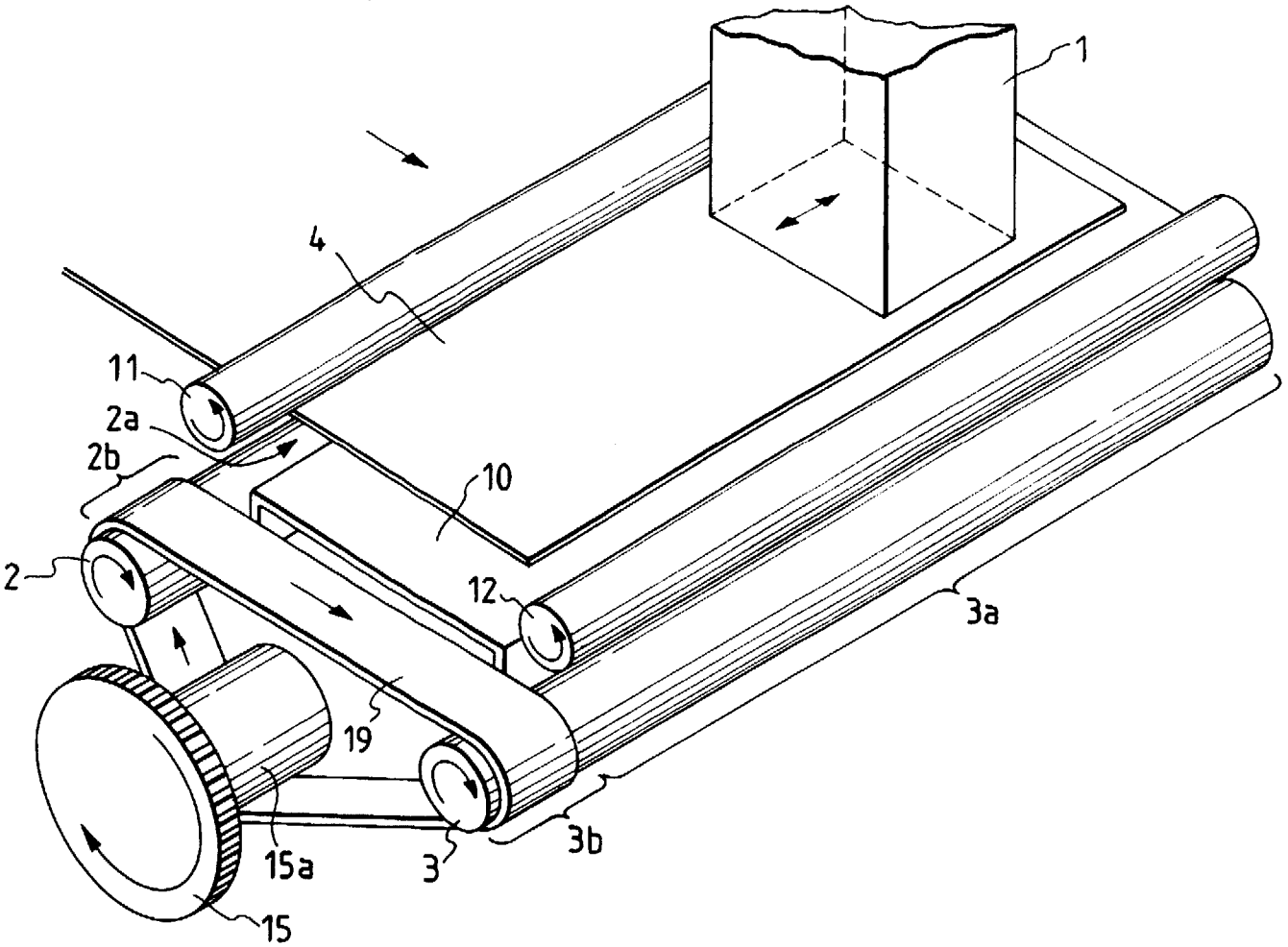
FIG. 1 is a perspective view of a sheet conveying apparatus according to a first embodiment of the present invention.

First of all, a sheet conveying apparatus according to a first embodiment of the present invention will now be fully explained with reference to FIGS. 1 and 2, which sheet conveying apparatus is applied to a sheet conveying portion of an ink jet recording apparatus. FIG. 1 is a perspective view of the sheet conveying apparatus according to the first embodiment of the present invention, and FIG. 2 is a side view of the sheet conveying apparatus of FIG. 1.

Figure 2:
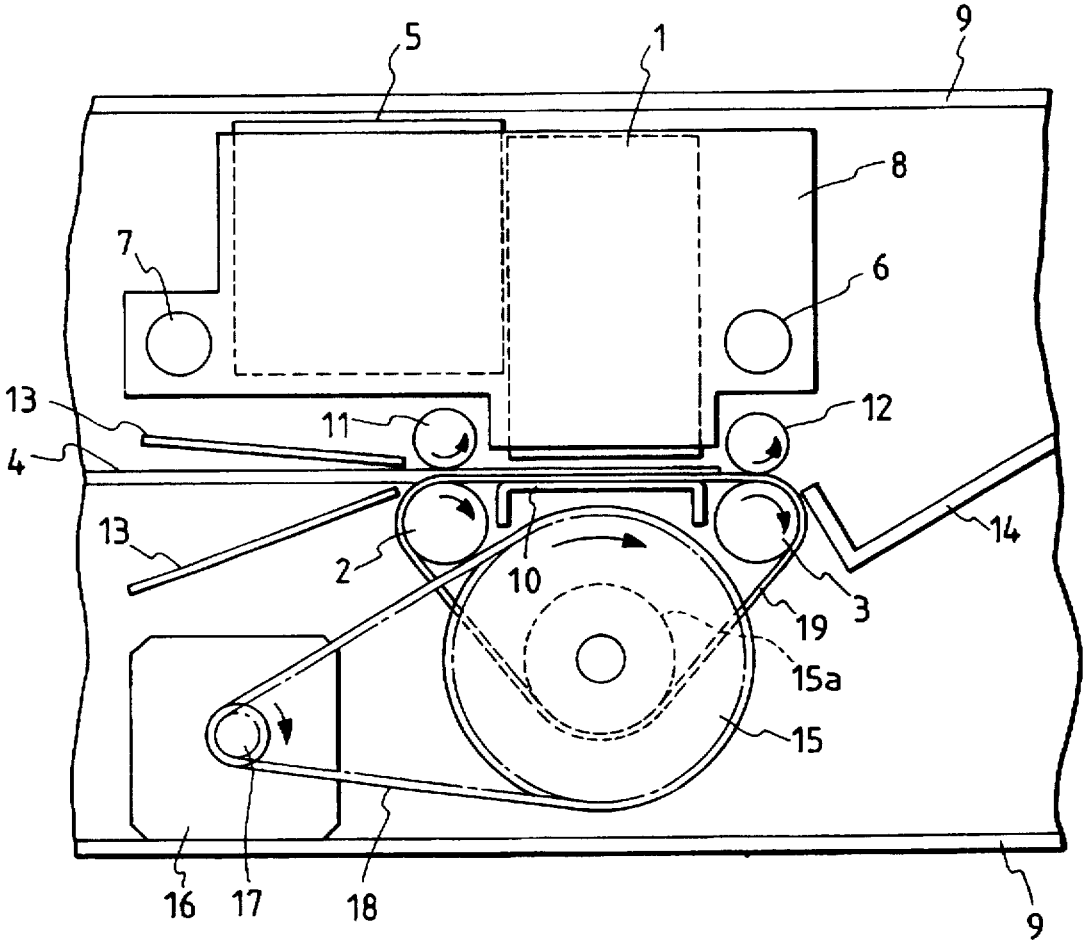
FIG. 2 is a side view of the sheet conveying apparatus of FIG. 1.

In FIGS. 1 and 2, the ink jet recording apparatus includes a recording head 1 of so-called ink jet type which can effect the recording by selectively discharging ink from a plurality of nozzles, and convey rollers (convey rotary members) 2, 3 for conveying a sheet (paper sheet or any sheets made of predetermined material such as synthetic resin and the like) to a recording area where the sheet is opposed to the recording head 1.

In FIG. 2, there is provided an ink tank 5 for supplying the ink to the recording head 1. The recording head 1 and the ink tank 5 are mounted on a main scan carriage 8 which is supported by guide rails 6, 7 so that these elements 1, 5 can be reciprocally shifted along the guide rails 6, 7 in a direction (main scan direction) perpendicular to a sheet conveying direction (sub scan direction).

Power from a drive means (not shown) such as a reversible control motor provided in the ink jet recording apparatus 9 is transmitted to the main scan carriage 8 through a timing belt (not shown) so that the carriage can be reciprocally shifted through the recording area. A platen plate 10 disposed in a confronting relation to the recording head 1 serves to support a lower surface of the sheet 4 to maintain a predetermined distance between a recording surface (upper surface) of the sheet and a head surface of the recording head 1.

The convey roller (first convey rotary member) 2 is disposed at an upstream side of the recording head 1 in the sheet conveying direction (sub scan direction) and the convey roller (second convey rotary member) 3 is disposed at a downstream side of the recording head 1 in the sheet conveying direction, and pinch rollers 11, 12 are urged against the convey rollers 2, 3 by means of biasing means (not shown) with predetermined biasing forces, respectively. Accordingly, the sheet 4 supplied from a sheet supply means (not shown) is guided by sheet guides 13 provided in the ink jet recording apparatus 9 to be entered into a nip between the convey roller 2 and the pinch roller 11, with the result that the sheet is conveyed to a recording portion between the recording head 1 and the platen plate 10 by means of the convey roller 2 and the pinch roller 11.

In the recording portion, recording information such as characters and/or images are recorded on the recording surface of the sheet 4 by shifting the sheet 4 in the sub scan direction and by controlling the reciprocal movement of the recording head 1 in the main scan direction and by controlling the discharge of the ink from the recording head 1. Then, the sheet 4 is entered into a nip between the convey roller 3 and the pinch roller 12 to be conveyed by these rollers and then is discharged onto a discharge tray 14 disposed at a downstream side of the convey roller 3 in the sub scan direction.

Next, a drive means for the convey rollers 2, 3 will be explained.

A drive pulley 15 is rotatably mounted on a drive shaft 15*a* within the ink jet recording apparatus 9. The drive pulley 15 is disposed in such a manner that an uppermost portion of an outer peripheral surface of the drive pulley is situated below a sheet convey path so that the drive pulley 15 does not affect an influence upon the recording area of the recording head11. With this arrangement, the apparatus 9 can be made compact.

The apparatus 9 is provided with a drive motor 16 and a motor pulley 17 is secured to a drive shaft of the drive motor 16. A toothed drive belt 18 is wound around the drive pulley 15 and the motor pulley 17 so that a rotational force of the drive motor 16 can be transmitted to the drive pulley 15 through the drive belt 18.

The drive pulley 15 is subjected to a proper tension force from a tensioner means (not shown) so that slack is not generated in the drive belt 18. A flat belt 19 is wound around an outer peripheral surface of the drive shaft 15*a* to which the drive pulley 15 is secured and outer peripheral surfaces of the convey rollers 2, 3 in such a manner that an inner surface of the flat belt is contacted with these outer peripheral surfaces. With this arrangement, a rotational force of the drive shaft 15*a* of the drive pulley 15 is transmitted to the convey rollers 2, 3 through the flat belt 19. The flat belt 19 is subjected to a proper tension force from a tensioner means (not shown) so that the slack is not generated in the flat belt 19 and the flat belt is prevented from slipping with respect to the peripheral surfaces of the drive shaft 15*a*, and the convey rollers 2, 3.

With the arrangement as mentioned above, since the outer peripheral surface of the drive shaft 15*a* of the drive pulley 15 and the outer peripheral surfaces of the convey rollers 2, 3 are contacted with the inner surface of the same flat belt 19, a shift amount of the outer peripheral surface of the drive shaft 15*a* is converted into shift amounts of the outer peripheral surfaces of the convey rollers 2, 3 via the flat belt 19, with the result that these three shift amounts become the same as each other.

Further, since the inner surface of the flat belt 19 is directly wound around the same peripheral surfaces having the same diameters of the outer peripheral surfaces of the convey rollers 2, 3 for conveying the sheet 4 while contacting with the convey surface (lower surface) of the sheet 4, the shift amounts of the outer surfaces of the convey rollers 2, 3 become the same as a conveyed amount of the sheet 4 conveyed by the convey rollers 2, 3. Accordingly, the shift amount of the outer peripheral surface of the drive shaft 15*a* can be made the same as the conveyed amount of the sheet 4.

With the arrangement as mentioned above, by controlling the shift amount of the outer peripheral surface of the drive shaft 15*a* of the drive pulley 15, the conveyed amount of the sheet 4 can be controlled regardless of the tolerance of the outer diameters of the convey rollers 2, 3. Further, since the shift amounts of the outer peripheral surfaces of the convey rollers 2, 3 can be made the same as each other, in the recording portion between the convey rollers 2, 3, the sheet 4 is prevented from slacking and pulling, thereby conveying the sheet stably. That is to say, after the trail end of the sheet leaves the convey roller 2, even when the sheet is conveyed by the convey roller 3 alone, the sheet 4 can be conveyed at the normal conveying speed.

The flat belt 19 may be made of synthetic resin such as fluororesin (for example, polycarbonate, polyethylene, polyamide) or the flat belt may be constituted by a laminated belt having an inner layer made of elastic rubber such as urethane rubber and an outer layer including a core made of resin or metal. Alternatively, the flat belt may be made of metal or hard rubber alone.

Further, it is desirable that the flat belt 19 has less extensibility, uniform thickness tolerance and no seam. When the flat belt is made of synthetic resin such as fluororesin (for example, polycarbonate, polyethylene, polyamide), it is possible to obtain a seamless flat belt which is inexpensive and which has extension rate of 1% or less and thickness tolerance of 5–20 μm, with the result that the sheet can be conveyed with high accuracy.

The convey rollers 2, 3 have convey portions 2*a*, 3*a* contacted with the sheet and adapted to convey the sheet, and a driven portions 2*b*, 3*b* contacted with the flat belt and adapted to receive the driving force.

The convey portion 2*a* and the driven portion 2*b*, or the convey portion 3*a* and driven portion 3*b* are simultaneously machined under the same cutting and polishing condition so as to be formed as a one-piece member having the same or substantially the same diameters. That is to say, the convey portion and the driven portion are continuously machined while being chucked by the same spindle.

By uniformly striking particle abrasive agent against the entire work piece or against the convey portion at a high speed, the shot blast working is performed.

When the outer surface of the convey roller 2 or 3 is constituted by rubber, both the convey portion and the driven portion are made as a metal shaft having the uniform diameter and a cylindrical rubber sleeve is fitted onto or adhered onto an outer surface of the metal shaft. If necessary, an outer surface of the rubber sleeve is polished.

Next, a second embodiment of the present invention will be explained with reference to FIGS. 3 and 4. Incidentally, the same elements as those in the first embodiment are designated by the same reference numerals and explanation thereof will be omitted.

Figure 3:
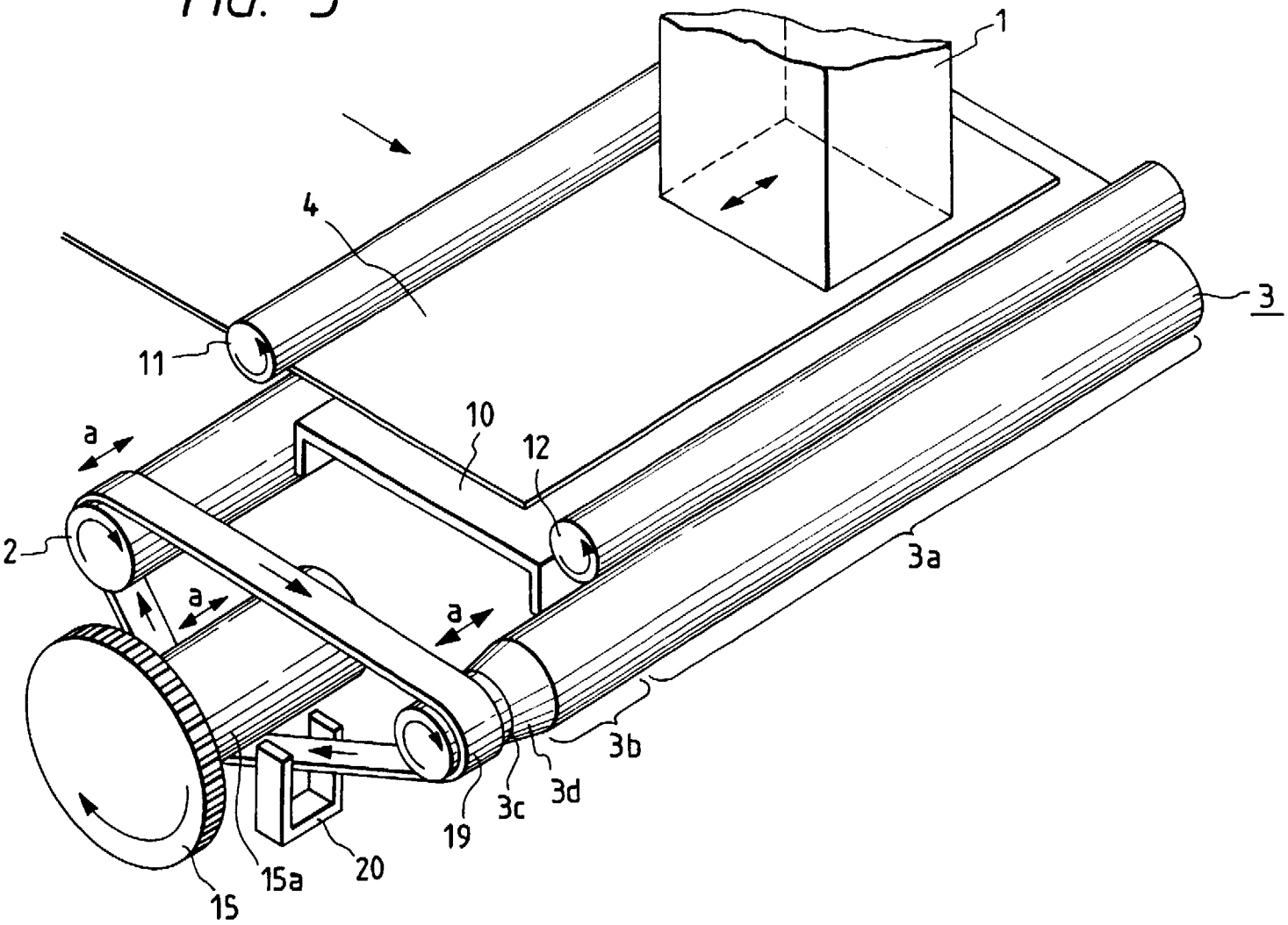
FIGS. 3 and 4 are perspective views of a sheet conveying apparatus according to a second embodiment of the present invention.
Figure 4:
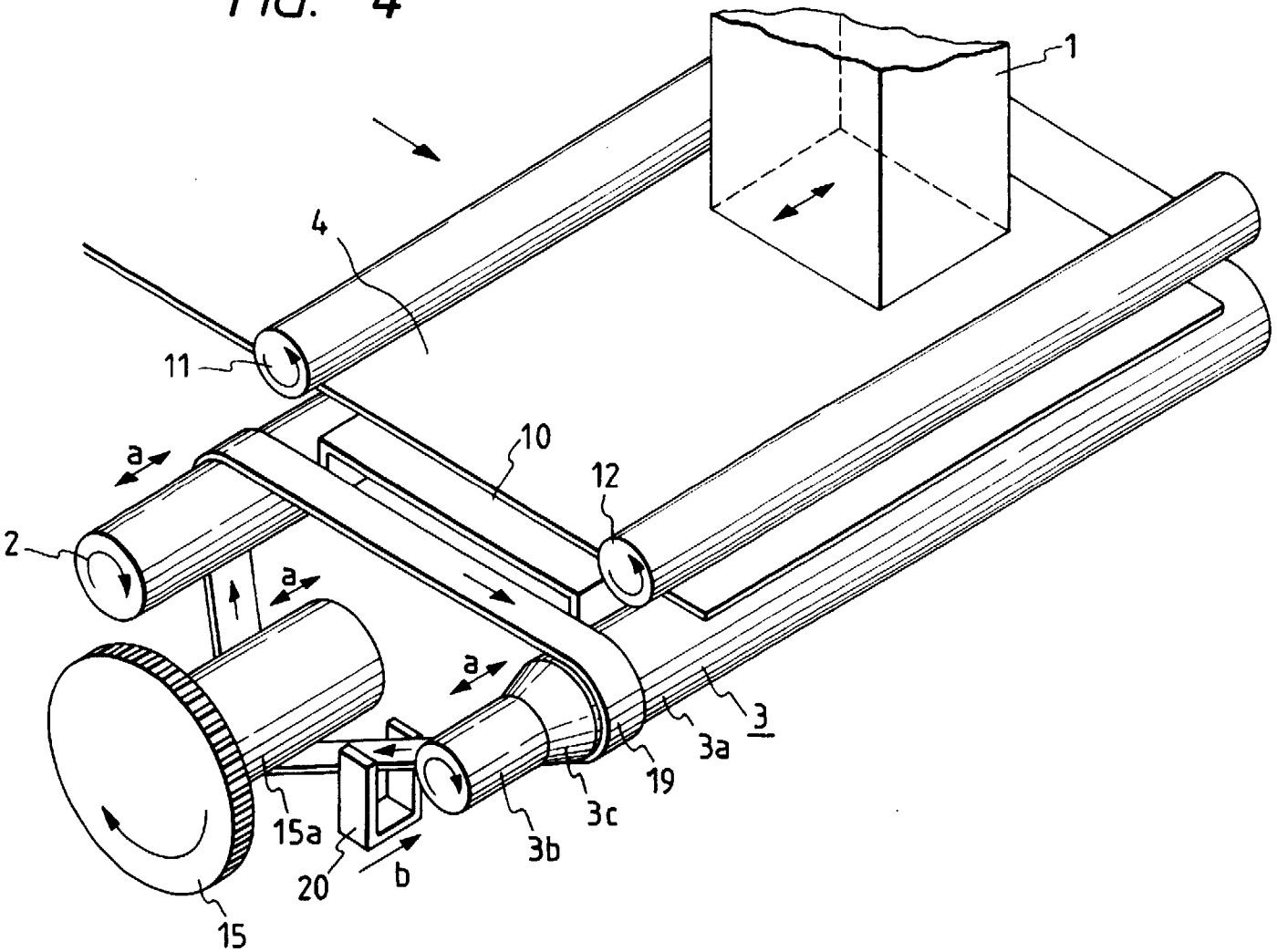
Figure 5:
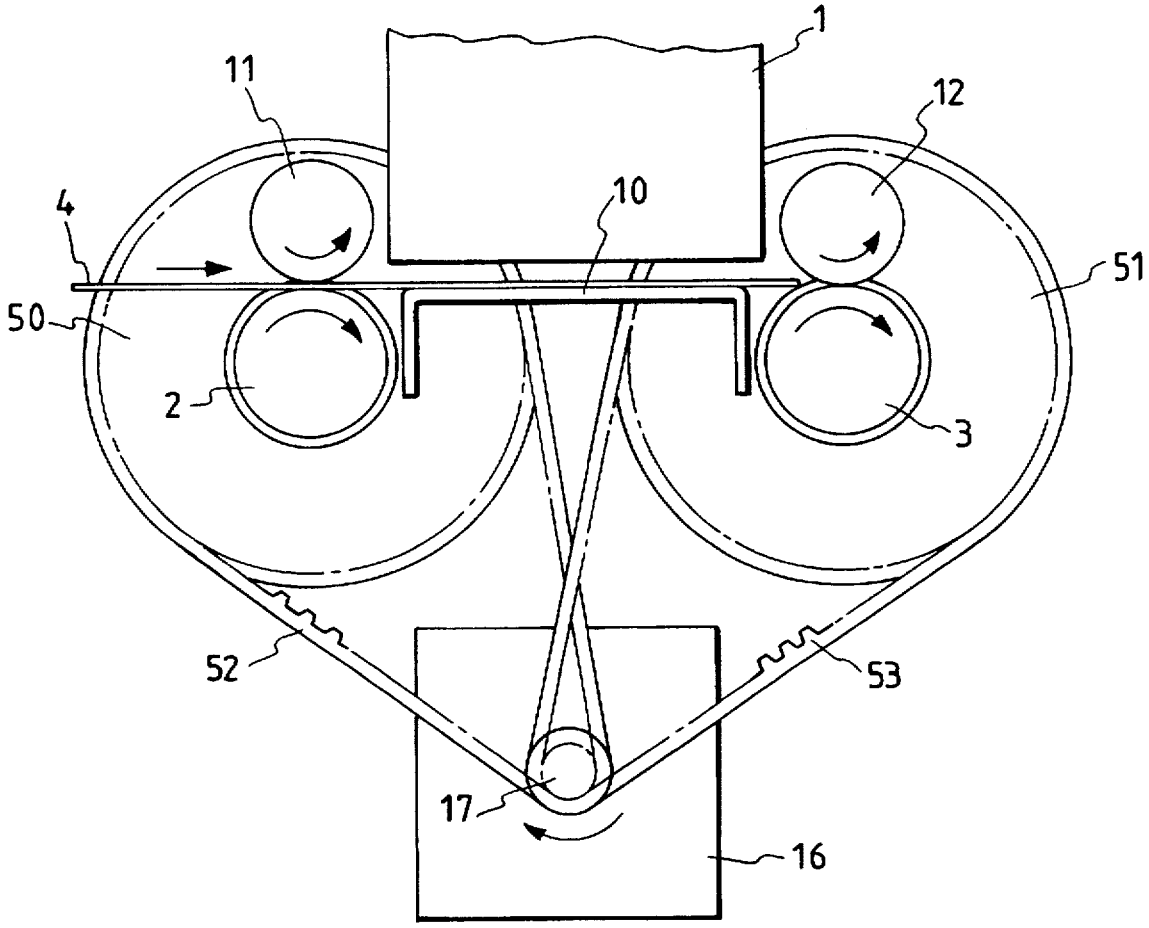
FIG. 5 is an explanatory view showing a conventional sheet conveying apparatus.

In the second embodiment, as shown in FIGS. 3 and 4, the convey roller 3 has a stepped end portion including an outer peripheral surface 3*b* having the same diameter as the outer peripheral surface 3*a* and an outer peripheral surface 3*c* having a diameter smaller than that of the outer peripheral surface 3*b*. The outer peripheral surface 3*b* is connected to the outer peripheral surface 3*c* via a tapered surface 3*d* having a predetermined inclined angle.

The ink jet recording apparatus 9 is provided with a belt holder 20 which is driven by a drive means in a direction (shown by the arrow a) perpendicular to the sheet conveying direction. By driving the belt holder 20, the flat belt 19 wound around the convey rollers 2, 3 and the drive shaft 15*a* of the drive pulley 15 is shifted in the direction a so that the flat belt can selectively be mounted on the outer peripheral surface 3*b* or the outer peripheral surface 3*c*.

When the flat belt 19 is mounted on the outer peripheral surface 3*c*, the flat belt 19 is subjected to the proper tension force from the tensioner means so that the slack in the belt is eliminated and the flat belt 19 is prevented from slipping with respect to the outer peripheral surface of the drive shaft 15*a* and the convey rollers 2, 3.

As shown in FIG. 3, before the sheet 4 enters into the nip between the convey roller 3 and the pinch roller 12, the flat belt 19 is mounted on the outer peripheral surface 3*c* having the smaller diameter. In this case, the shift amount of the outer peripheral surface 3*a* of the convey roller 3 becomes greater than the shift amount of the outer peripheral surface of the convey roller 2 by an amount corresponding to the difference in circumferential length between the outer peripheral surface 3*b* and the outer peripheral surface 3*c* of the convey roller 3. As a result, when the sheet 4 enters into the nip between the convey roller 3 and the pinch roller 12, if the slack is generated in the sheet to form the loop, such a loop can be eliminated due to the increased shift amount of the outer peripheral surface 3*a* of the convey roller 3.

Further, in this case, since the conveying force (sheet pushing force) of the convey roller 2 is smaller than the conveying force (sheet pulling force) of the convey roller 3, after the loop is eliminated, the convey roller 3 can apply to the sheet 4 a tension force which does not affect an influence upon the conveyance of the convey roller 2.

After the sheet 4 enters into and pinched by the nip between the convey roller 3 and the pinch roller 12, as shown in FIG. 4, by shifting the belt holder 20 by the drive means in a direction shown by the arrow b in FIG. 4, the flat belt 19 is shifted from the outer peripheral surface 3*c* to the outer peripheral surface 3*b* through the tapered surface 3*d*, with the result that the increased shift amount of the outer peripheral surface 3*a* of the convey roller 3 is disappears to attain the same shift amounts between the convey roller 2 and the outer peripheral surface 3*a* of the convey roller 3, thereby stabilizing the conveyed amount of the sheet 4.

Incidentally, in the above-mentioned embodiments, while an example that the flat belt 19 is mounted on the drive shaft 15*a* of the drive pulley 15 was explained, the flat belt 19 may be mounted on the drive pulley 15. With this arrangement, by controlling the shift amount of the outer peripheral surface of the drive pulley 15, as in the aforementioned embodiments, the conveyed amount of the sheet 4 can be controlled regardless of the tolerance of the diameters of the convey roller 2, 3.

Further, in the above-mentioned embodiments, while an example that the flat belt 19 is mounted on the end portions (i.e. left end portions as shown in FIG. 1) of the convey rollers 2, 3 outside the recording area was explained, the flat belt 19 may be mounted on right end portions of the convey rollers in FIG. 1, or two flat belts may be mounted on both end portions of the convey rollers. In addition, in place of the drive belt 18, a gear train may be used to transmit the driving force from the drive motor 16 to the drive pulley 15.

The ink jet recording head used in the first and second embodiments has heat generating elements provided in nozzles so that a bubble is generated in the ink by thermal energy generated by each heat generating element and an ink droplet is discharged from the nozzle due to the growth of the bubble.

According to the sheet conveying apparatus of the present invention, the shift amount of the outer peripheral surface of the drive pulley or the shift amount of the outer peripheral surface of the drive shaft of the drive pulley can directly be transmitted to the outer peripheral surfaces of the convey rotary members through the flat belt. Accordingly, the shift amount of the outer peripheral surface of the drive pulley can be transmitted to the outer peripheral surfaces of the convey rotary members with high accuracy regardless of the tolerance of the outer diameters of the convey rotary members, thereby conveying the sheet with high accuracy. Thus, the convey rotary members can be manufactured with less tolerance, thereby reducing the manufacturing cost.

Further, since the sheet can be conveyed with high accuracy, the means for detecting the conveyed amount of the sheet is not required, thereby reducing the number of parts and making the apparatus more compact and inexpensive.

Furthermore, since the convey amount (conveying speed) of the first convey rotary member can become the same as the convey amount of the second convey rotary member, in the recording portion between the first and second convey rotary members, the sheet is prevented from loosening or pulling, thereby conveying the sheet stably. That is to say, after the trail end of the sheet leaves the first convey rotary member, even when the sheet is conveyed by the second convey rotary member alone, since the sheet can be conveyed at the normal conveying speed, the characters and/or images recorded on the sheet are not distorted.

In addition, after the tip end of the sheet leaves the first convey rotary member and before the sheet enters into the second convey rotary member, when the conveyed amount of the sheet conveyed by the second convey rotary member is greater than the conveyed amount of the sheet conveyed by the first convey rotary member, after the tip end of the sheet leaves the first convey rotary member, when the sheet enters into the second convey rotary member, even if the loop is formed in the sheet, such a loop can be eliminated.

Further, after the tip end of the sheet leaves the second convey rotary member, since the shift amounts of the first and second convey rotary members become the same as each other, after the trail end of the sheet leaves the first convey rotary member, even when the sheet is conveyed by the second convey rotary member alone, the sheet can be conveyed at the normal conveying speed.

Furthermore, when the conveying force of the second convey rotary member is smaller than the conveying force of the first convey rotary member, after the loop is eliminated from the sheet, the second convey rotary member can apply to the sheet the tension force which does not affect an influence upon the conveyance of the first convey rotary member, thereby conveying the sheet in a good manner.

Lastly, since the drive pulley is not secured to the convey rotary members, the recording head is not overlapped with the drive pulley in the vertical direction, thereby making the apparatus compact.

What is claimed is:

1. A sheet conveying apparatus comprising:

a convey rotary member having a driven portion and a convey portion for conveying a sheet;

a drive pulley having a drive shaft; and a belt wound between (i) an outer peripheral surface of said driven portion of said convey rotary member and (ii) an outer peripheral surface of said drive pulley for transmitting a rotational force to said convey rotary member or an outer peripheral surface of a drive shaft of said drive pulley, a diameter of said convey portion being substantially the same as a diameter of said driven portion, and the rotational force of said drive pulley being transmitted to said convey rotary member by said belt.

2. A sheet conveying apparatus according to claim 1, wherein the same surface of said belt is contacted with the outer peripheral surface of said convey rotary member and the outer peripheral surface of said drive pulley or the outer peripheral surface of said pulley shaft of said drive pulley.

3. A sheet conveying apparatus according to claim 2, further comprising a second convey rotary member and means for, after a tip end of the sheet leaves said first convey rotary member and before the tip end of the sheet enters into said second convey rotary member, controlling a convey amount of the sheet conveyed by said second convey rotary member to be greater than a convey amount of the sheet conveyed by said first convey rotary member, and, after the tip end of the sheet leaves said second convey rotary member, controlling the convey amount of the sheet conveyed by said first convey rotary member to be the same as the convey amount of the sheet conveyed by said second convey rotary member.

4. A sheet conveying apparatus according to claim 3, wherein a conveying force of said second convey rotary member is smaller than a conveying force of said first convey rotary member.

5. A sheet conveying apparatus according to claim 4, wherein said sheet conveying apparatus is applied to a sheet conveying portion of an ink jet recording apparatus for recording an image on the sheet by selectively discharging the ink from a plurality of nozzles.

6. A sheet conveying apparatus according to claim 5, wherein said belt has a flat shaped cross section.

7. A sheet conveying apparatus according to claim 4, wherein said belt has a flat shaped cross section.

8. A sheet conveying apparatus according to claim 3, wherein said sheet conveying apparatus is applied to a sheet conveying portion of an ink jet recording apparatus for recording an image on the sheet by selectively discharging the ink from a plurality of nozzles.

9. A sheet conveying apparatus according to claim 8, wherein said belt has a flat shaped cross section.

10. A sheet conveying apparatus according to claim 3, wherein said belt has a flat shaped cross section.

11. A sheet conveying apparatus according to claim 2, wherein said sheet conveying apparatus is applied to a sheet conveying portion of an ink jet recording apparatus for recording an image on the sheet by selectively discharging the ink from a plurality of nozzles.

12. A sheet conveying apparatus according to claim 11, wherein said belt has a flat shaped cross section.

13. A sheet conveying apparatus according to claim 2, wherein said belt has a flat shaped cross section.

14. A sheet conveying apparatus according to claim 1, wherein said sheet conveying apparatus is applied to a sheet conveying portion of an ink jet recording apparatus for recording an image on the sheet by selectively discharging the ink from a plurality of nozzles.

15. A sheet conveying apparatus according to claim 14, wherein said belt has a flat shaped cross section.

16. A sheet conveying apparatus according to claim 1, wherein said belt has a flat shaped cross section.

17. A sheet conveying apparatus comprising:

a first convey rotary member having a first convey portion and a first driven portion and being disposed at an upstream side of a recording head in a sheet conveying direction to convey a sheet by said first convey portion;

a second convey rotary member having a second convey portion and a second driven portion and being disposed at a downstream side of said recording head in the sheet conveying direction to convey the sheet by said second convey portion;

a drive pulley for transmitting a rotational force to said first and second convey rotary members and having a pulley shaft;

driving means for driving said drive pulley; and a belt wound among (i) an outer peripheral surface of said first driven portion of said first convey rotary member, (ii) an outer peripheral surface of said second driven portion of said second convey rotary member, and (iii) an outer peripheral surface of said drive pulley or an outer peripheral surface of said pulley shaft of said drive pulley, wherein a diameter of said first convey portion of said first convey rotary member is almost the same as a diameter of said first driven portion thereof, and a diameter of said second convey portion of said second convey rotary member is substantially the same as a diameter of said second driven portion thereof, and the rotational force of said driven pulley is transmitted to said first and second convey rotary members by said belt.

18. A sheet conveying apparatus according to claim 17, wherein the same surface of said belt is contacted with the outer peripheral surface of said first and second convey rotary members and the outer peripheral surface of said drive pulley or the outer peripheral surface of said pulley shaft of said drive pulley.

19. A sheet conveying apparatus according to claim 18, further comprising means for, after a tip end of the sheet leaves said first convey rotary member and before the tip end of the sheet enters into said second convey rotary member, controlling a convey amount of the sheet conveyed by said second convey rotary member to be greater than a convey amount of the sheet conveyed by said first convey rotary member, and, after the tip end of the sheet leaves said second convey rotary member, controlling the convey amount of the sheet conveyed by said first convey rotary member to be the same as the convey amount of the sheet conveyed by said second convey rotary member.

20. A sheet conveying apparatus according to claim 19, wherein a conveying force of said second convey rotary member is smaller than a conveying force of said first convey rotary member.

21. A sheet conveying apparatus according to claim 20, wherein said sheet conveying apparatus is applied to a sheet conveying portion of an ink jet recording apparatus for recording an image on the sheet by selectively discharging the ink from a plurality of nozzles.

22. A sheet conveying apparatus according to claim 21, wherein said belt has a flat shaped cross section.

23. A sheet conveying apparatus according to claim 20, wherein said belt has a flat shaped cross section.

24. A sheet conveying apparatus according to claim 19, wherein said sheet conveying apparatus is applied to a sheet conveying portion of an ink jet recording apparatus for recording an image on the sheet by selectively discharging the ink from a plurality of nozzles.

25. A sheet conveying apparatus according to claim 24, wherein said belt has a flat shaped cross section.

26. A sheet conveying apparatus according to claim 19, wherein said belt has a flat shaped cross section.

27. A sheet conveying apparatus according to claim 18, further comprising means for, after a tip end of the sheet leaves said first convey rotary member and before the tip end of the sheet enters into said second convey rotary member, controlling a convey amount of the sheet conveyed by said second convey rotary member to be greater than a convey amount of the sheet conveyed by said first convey rotary member, and, after the tip end of the sheet leaves said second convey rotary member, controlling the convey amount of the sheet conveyed by said first convey rotary member to be the same as the convey amount of the sheet conveyed by said second convey rotary member.

28. A sheet conveying apparatus according to claim 27, wherein a conveying force of said second convey rotary member is smaller than a conveying force of said first convey rotary member.

29. A sheet conveying apparatus according to claim 28, wherein said sheet conveying apparatus is applied to a sheet conveying portion of an ink jet recording apparatus for recording an image on the sheet by selectively discharging the ink from a plurality of nozzles.

30. A sheet conveying apparatus according to claim 29, wherein said belt has a flat shaped cross section.

31. A sheet conveying apparatus according to claim 28, wherein said belt has a flat shaped cross section.

32. A sheet conveying apparatus according to claim 27, wherein said sheet conveying apparatus is applied to a sheet conveying portion of an ink jet recording apparatus for recording an image on the sheet by selectively discharging the ink from a plurality of nozzles.

33. A sheet conveying apparatus according to claim 32, wherein said belt has a flat shaped cross section.

34. A sheet conveying apparatus according to claim 27, wherein said belt has a flat shaped cross section.

35. A sheet conveying apparatus according to claim 18, wherein said sheet conveying apparatus is applied to a sheet conveying portion of an ink jet recording apparatus for recording an image on the sheet by selectively discharging the ink from a plurality of nozzles.

36. A sheet conveying apparatus according to claim 35, wherein said belt has a flat shaped cross section.

37. A sheet conveying apparatus according to claim 18, wherein said belt has a flat shaped cross section.

38. A sheet conveying apparatus according to claim 17, wherein said sheet conveying apparatus is applied to a sheet conveying portion of an ink jet recording apparatus for recording an image on the sheet by selectively discharging the ink from a plurality of nozzles.

39. A sheet conveying apparatus according to claim 38, wherein said belt has a flat shaped cross section.

40. A sheet conveying apparatus according to claim 17, wherein said belt has a flat shaped cross section.

41. A sheet conveying apparatus comprising:

a cylindrical convey rotary member, having a driven portion and a convey portion, for conveying a sheet by said convey portion while rotating and contacting with the sheet; and a drive belt wound around an outer peripheral surface of said driven portion of said convey rotary member to transmit a driving force from a drive source to said convey rotary member, wherein a diameter of said convey portion is substantially the same as a diameter of said driven portion.

42. A sheet conveying apparatus according to claim 41, wherein said convey rotary member has a peripheral surface which is continuous in a longitudinal direction.

43. A sheet conveying apparatus according to claim 42, wherein said convey rotary member has a substantially uniform diameter along its entire length.

44. A sheet conveying apparatus according to claim 43, wherein said belt has a flat shaped cross section.

45. A sheet conveying apparatus according to claim 42, wherein said belt has a flat shaped cross section.

46. A sheet conveying apparatus according to claim 41, wherein said belt has a flat shaped cross section.

47. A sheet conveying apparatus comprising:

a cylindrical convey rotary member for conveying a sheet while rotating and contacting with the sheet; and a drive belt wound around an outer peripheral surface of said convey rotary member to transmit a driving force from a drive source to said convey rotary member, wherein said convey rotary member has a peripheral surface which is continuous in a longitudinal direction thereof, and wherein said convey rotary member has a convey portion contacted with the sheet, and a driven portion on which said drive belt is mounted and to which the driving force is transmitted, said convey portion and said driven portion are formed integrally with each other, wherein a diameter of said convey portion is substantially the same as a diameter of said driven portion, and outer peripheral surfaces of said convey portion and said driven portion are formed by the same and continuous working operation.

48. A sheet conveying apparatus according to claim 47, wherein shot blast working is applied to only said convey portion of said convey rotary member.

49. A sheet conveying apparatus according to claim 48, wherein said belt has a flat shaped cross section.

50. A sheet conveying apparatus according to claim 47, wherein said convey portion has a diameter substantially the same as a diameter of said driven portion, and said convey portion and said driven portion have substantially uniform diameters along their entire lengths.

51. A sheet conveying apparatus according to claim 50, wherein said belt has a flat shaped cross section.

52. A sheet conveying apparatus according to claim 47, wherein said belt has a flat shaped cross section.

53. An image forming apparatus comprising:

a cylindrical first convey rotary member for conveying a sheet while rotating and contacting with the sheet;

an image forming means disposed at a downstream side of said first convey rotary member and adapted to form an image on the sheet conveyed by said first convey rotary member;

a cylindrical second convey rotary member disposed at a downstream side of said image forming means to convey the sheet while rotating and contacting with the sheet; and a drive belt wound around outer peripheral surfaces of said first and second convey rotary members to transmit a driving force from a drive source to said convey rotary members.

54. An image forming apparatus according to claim 53, wherein said first and second convey rotary members have substantially uniform diameters along their entire lengths.

55. An image forming apparatus according to claim 54, wherein said belt has a flat shaped cross section.

56. An image forming apparatus according to claim 53, wherein each of said first and second convey rotary members has a convey portion contacted with the sheet, and a driven portion on which said drive belt is mounted and to which the driving force is transmitted, said convey portion and said driven portion are formed integrally with each other, and outer peripheral surfaces of said convey portion and said driven portion are formed by the same and continuous working operation.

57. An image forming apparatus according to claim 56, wherein said convey portion and said driven portion of each of said first and second convey rotary members have substantially the same diameters.

58. An image forming apparatus according to claim 57, wherein said belt has a flat shaped cross section.

59. An image forming apparatus according to claim 56, wherein said driven portion of said second convey rotary member comprises a first driven portion and a second driven portion having a diameter smaller than that of said convey portion, and said apparatus further comprises switching means for selectively mounting said drive belt on said first driven portion or said second driven portion.

60. An image forming apparatus according to claim 59, wherein, after the sheet is started to be conveyed by said second convey rotary member, said switching means changes a condition that said drive belt is mounted on said second driven portion to a condition that said driven belt is mounted on said first driven portion.

61. An image forming apparatus according to claim 60, wherein said belt has a flat shaped cross section.

62. An image forming apparatus according to claim 59, wherein said first driven portion of said second convey rotary member has a diameter substantially the same as that of said convey portion of said second convey rotary member.

63. An image forming apparatus according to claim 62, wherein said first driven portion of said second convey rotary member has a diameter substantially the same as that of said driven portion of said first convey rotary member.

64. An image forming apparatus according to claim 63, wherein said driven portion of said first convey rotary member has a diameter substantially the same as that of said convey portion of said first convey rotary member.

65. An image forming apparatus according to claim 64, wherein said belt has a flat shaped cross section.

66. An image forming apparatus according to claim 63, wherein said belt has a flat shaped cross section.

67. An image forming apparatus according to claim 62, wherein said belt has a flat shaped cross section.

68. An image forming apparatus according to claim 59, wherein said belt has a flat shaped cross section.

69. An image forming apparatus according to claim 56, wherein said belt has a flat shaped cross section.

70. An image forming apparatus according to claim 53, wherein said image forming means forms the image by discharging an ink droplet.

71. An image forming apparatus according to claim 70, wherein said image forming means forms the image by discharging the ink droplet by utilizing thermal energy.

72. An image forming apparatus according to claim 71, wherein said belt has a flat shaped cross section.

73. An image forming apparatus according to claim 70, wherein said belt has a flat shaped cross section.

74. An image forming apparatus according to claim 53, wherein said belt has a flat shaped cross section.

* * * * *